US005333782A

United States Patent [19]

Frauenberger

[11] Patent Number: 5,333,782

[45] Date of Patent: Aug. 2, 1994

[54] MAILBOX

[75] Inventor: Andreas Frauenberger, Grossburgwedel, Fed. Rep. of Germany

[73] Assignee: Frauenberger & Co. mbH, Fed. Rep. of Germany

[21] Appl. No.: 26,526

[22] Filed: Mar. 4, 1993

[30] Foreign Application Priority Data

Mar. 7, 1992 [DE] Fed. Rep. of Germany ..... 9203060

[51] Int. Cl.[5] ..... B65D 91/00

[52] U.S. Cl. ..... 232/28

[58] Field of Search ..... 232/1 B, 1 E, 17, 19, 232/24, 28, 21, 39; 248/128

[56] References Cited

U.S. PATENT DOCUMENTS

| | | | |
|---|---|---|---|
| 464,842 | 12/1891 | Anderson | 232/28 |
| 636,947 | 11/1899 | Bishop | 232/28 |
| 816,366 | 3/1906 | Pask | 232/28 |
| 955,730 | 4/1910 | Westelin | 232/28 |
| 961,897 | 6/1910 | Rosenberg et al. | 232/28 |
| 1,249,910 | 12/1917 | Deginder | 232/28 |
| 1,595,263 | 8/1926 | Thornberry | 232/28 |
| 1,810,769 | 6/1931 | Jaden | 232/17 |
| 3,981,413 | 9/1976 | Cornwell, Jr. | 232/17 |

*Primary Examiner*—Michael Milano
*Attorney, Agent, or Firm*—Allegretti & Witcoff, Ltd.

[57] ABSTRACT

A mailbox comprising a housing and a hinged box which pivots into the housing. The housing is rectangular and has two side walls and a top wall connected to a rear wall, but has no bottom wall. The box has two side walls and a bottom wall, but no top wall. The box pivots about pins connected the side walls of the housing at the lower front corners thereof. As the box is pivoted outwardly, a slot opens at the upper edge of the front wall for dropping mail into the box. A stop connected to the housing limits the pivoting range of the box and thus the size of the slot. The stop can be recessed to permit pivoting the box a greater distance to enlarge the slot for removing mail. A spring provided on the rear wall of the housing for biasing the box to closed position thus completely closing the access slot. After mail has been deposited by manually pivoting the box to open position, the box is released and it springs back to closed position.

11 Claims, 1 Drawing Sheet

MAILBOX

BACKGROUND OF THE INVENTION

This invention concerns a mailbox which, when locked, opens a limited distance to provide a filling slot and when unlocked, opens farther to permit removing deposited mail.

A variety of different types of mailboxes are known. Most mailboxes have a flap for deposit of mail and a separate closable door for removing the postal items.

SUMMARY OF THE INVENTION

The purpose of the present invention is to create a new type of mailbox which facilitates handling mail and is suitable for a continuous battery of boxes mounted side by side in rows and with one row above the other.

In accordance with this invention, the mailbox consists of two parts, namely a housing for mounting on a wall or similar structure and a hinged box for holding the postal items mounted within the housing. The box is arranged to pivot about its lower edge to provide an entry slot when pivoted outwardly and to close the slot when pivoted into said housing. The box is prestressed so it is normally biased into the closed position by spring action over a predetermined pivoting range. In a preferred form of this invention, a lock limits the pivoting range to the extent that the slot is wide enough to accommodate postal items deposited in the hinged box. The person, such as the mailman, depositing postal items in the mailbox needs only to pull the hinged box forward to the stop and release it after inserting the postal items. Then the hinged box automatically snaps back to the closed starting position due to the prestressing. The housing does not have any parts that project outward so the mailboxes designed according to this invention can be aligned in continuous horizontal and vertical rows.

The housing and hinged box can be manufactured extremely simply and inexpensively by the plastic injection molding method. The design according to this invention permits assembly by the purchaser by a simple procedure.

BRIEF DESCRIPTION OF THE DRAWING

This invention will be explained in greater detail below with reference to the accompanying drawing in which the single FIGURE is a perspective view of a mailbox constructed in accordance with the invention.

DETAILED DESCRIPTION

Figure 1:
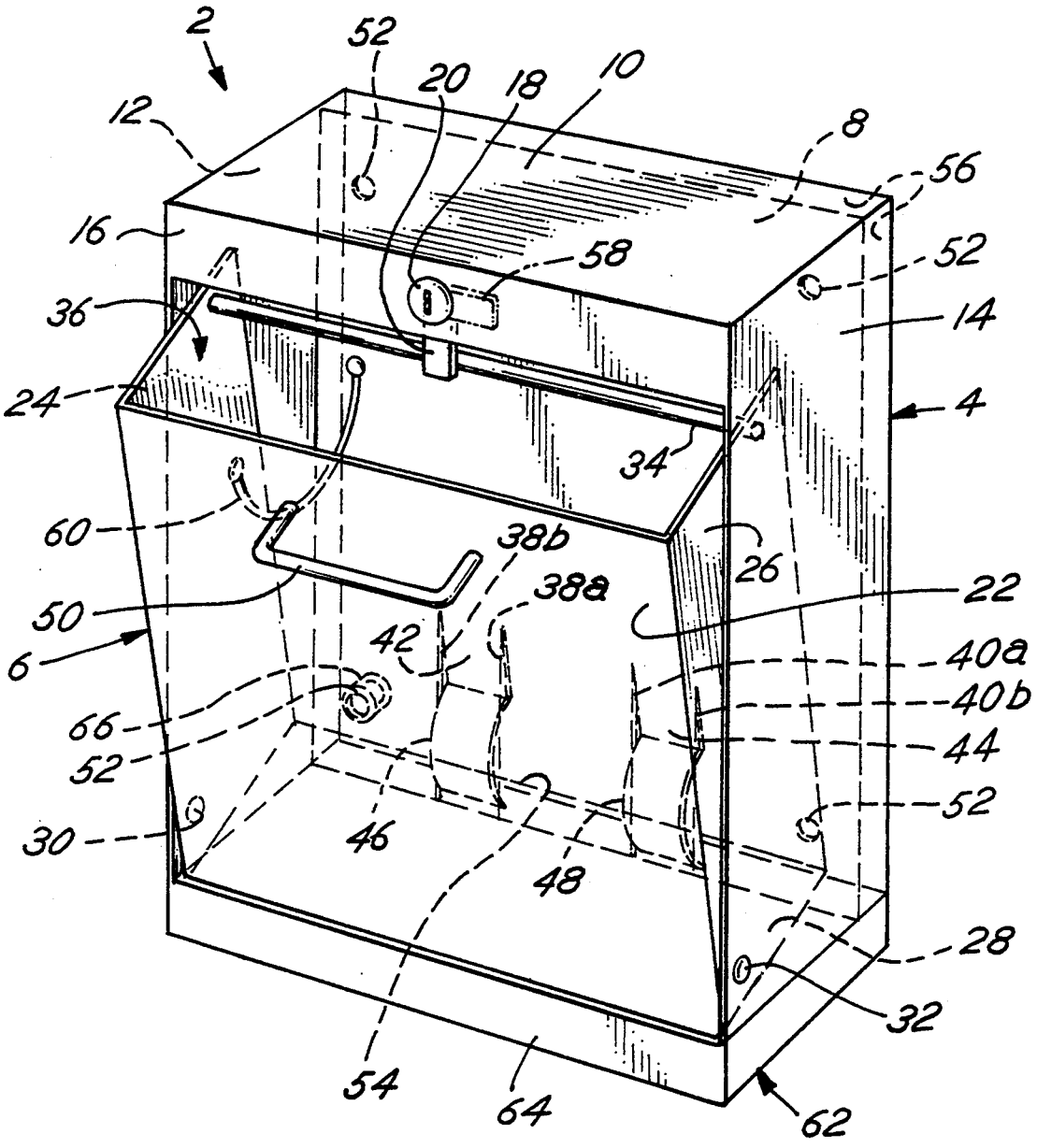

The figure shows a mailbox 2 with a housing 4 and a hinged box 6 that is arranged so that it can pivot into the housing.

The housing is rectangular in shape with a rear wall 8, a top covering wall 10 and two side walls 12 and 14. Furthermore, housing 4 has a short front upper wall 16 extending downwardly from top wall 10 on which is mounted a lock 18 with a stop bar 20. Housing 4 is preferably open at the bottom.

Hinged box 6 consists of a front wall 22, two side walls 24, 26 and a bottom 28. The top is open.

At the bottom the hinged box 6 is pivotally mounted at its side walls 24, 26 so it can rotate in the side walls 12 and 14 of housing 4. For this purpose, aligned boreholes receive rivets or pins which serve as axes of rotation 30, 32 in the side walls 12, 14 and 24 and 26 of the housing and the hinged box, respectively.

Hinged box 6 has a connecting bar 34 which connects side walls 24 and 26 in the upper area. When stop bar 20 of housing 4 is in locked position (solid lines), it lies in the path of connecting rod 34 so that hinged box 6 can be pivoted out only to a limited extent, just enough to provide a slot 36 for depositing mail.

In rear wall 8, housing 4 has two pairs of slots **38*a*, 38*b* and 40*a*, 40*b* that are open at the lower end of rear wall 8 and form tongues 42, 44 between them that are provided with cylindrical protuberances 46 and 48 on the front side. The tongues act as springs which flex about an axis where the tongues connect to wall 8** like a living hinge.

Front wall 22 of hinged box 6 is provided with a handle 50 or other means for opening the mailbox.

The housing has mounting holes 52 in rear wall 8 by means of which the mailbox 2 can be mounted on a vertical wall by means of screws.

When the mailman wants to put a letter in the mailbox 2, he pulls handle 50 and swings the hinged box 6 outward. The pivoting range is limited by stop bar 20 against which connecting rod 34 abuts. In pivoting hinged box 6, the rear edge 54 of bottom 28 slides up the lower portion of cylindrical faces 46 and 48 of the tongues 42 and 44 which pushes the tongues rearwardly out of the plane of rear wall 8 against the biasing force of said tongues.

In order for tongues 42 and 44 to have sufficient room for pivoting, side walls 12, 14 and covering wall 10 are extended from rear wall 8 to form a peripheral flange 56. When the mailman releases the handle after depositing mail in hinged box 6, the hinged box automatically pivots back to the closed starting position under the biasing force of tongues 42 and 44, which push down on rear edge 54.

When the mailbox is to be emptied, stop bar 20 is pivoted by lock 18 into position 58 (dotted lines) so the bar 34 and thus hinged box 6 can swing out beyond stop 20 to provide access through a wider opening than slot 36. The edge 54 of the hinged box slides over cylindrical surfaces 46 and 48 of tongues 42 and 44.

In order to limit the pivoting range of hinged box 6 in the outward direction when the stop is not locked (position 58), an arresting device can be provided, for example, in the form of one or two flexible straps 60. The straps of desired length may be attached at one end to the inside of one or both side walls 24 or 26 of hinged box 6 and at the other end to the rear wall 8 or one or both side walls 12, 14 of housing 4.

The outward pivoting range of hinged box 6 can also be limited by the front wall 64 of peripheral flange 62 extending from the lower edges of the walls of housing 4. The upper edge of wall 64 serves as a stop for front wall 22 of hinged box 6.

Mounting holes 52 in housing 4 are preferably provided with spacer sleeves 66 molded on them on the back of rear wall 8 for reasons of stability as shown for the lower left mounting hole.

Housing 4 and hinged box 6 are preferably molded from plastic.

Mailbox 2 is designed so that no preassembly is necessary. Housing 4, hinged box 6, the rivets as axes of rotation 30, 32, handle 50, connecting rod 34 and lock 18 with lock bar 20 can be packaged and shipped as individual parts in a space-saving manner. Anyone can easily and quickly assemble the parts at the site.

The tongues with their cylindrical protuberances also function to keep the postal items some distance away from the slot between the bottom 28 of hinged box 6 and rear wall 8 of housing 4 so the mail placed in the box cannot become jammed in the slot.

I claim:

1. A mailbox comprising a housing having a rear wall, two side walls and a top wall, a box disposed within said housing having a front wall, a bottom wall and two side walls, said bottom wall having a rear edge, said side walls of said box being hinged to the side walls of said housing near the bottom thereof to permit pivoting said box to provide a slot between the upper edge of said front wall and the top wall of the housing, a bar connecting the side walls of said box at the upper ends of said side walls, a stop pivotally mounted on said housing which pivots into the path of said connecting bar to limit the pivoting range of said box, and a spring in the rear wall of said housing which bears against said rear edge normally to urge said box bottom downwardly thereby swivelling said box into said housing and closing said slot.

2. The mailbox of claim 1 in which said housing has a short front wall extending downwardly from said top wall and said stop is mounted on said short front wall.

3. The mailbox of claim 1 in which said spring consists of a hinged tongue cut out of the rear wall of said housing.

4. The mailbox of claim 3 in which said hinged tongue is formed with a curved surface projecting into said housing, said surface being disposed within the pivoting range of the rear edge of said box bottom.

5. The mailbox of claim 4 in which said curved surface is cylindrical.

6. The mailbox of claim 3 which has a pair of hinged tongues spaced apart on the lower end of said rear wall.

7. The mailbox of claim 6 which includes a peripheral flange projecting outwardly from said rear wall to provide a space for the pivoting range of said hinged tongues.

8. The mailbox of claim 7 in which said rear wall has mounting holes including spacer sleeves equal in length to the width of said peripheral flange.

9. The mailbox of claim 1 which includes a flexible strap between said housing and said box to limit the pivoting range of said box when said stop is in unlocked position.

10. The mailbox of claim 9 in which said strap connects a side wall of said box to an adjacent side wall of said housing.

11. The mailbox of claim 9 in which said housing has a peripheral flange extending downwardly from lower edges of said housing walls, a section of said flange extending downwardly at the front of said housing, serving in combination with the front wall of said box, as an additional stop to limit the pivoting range of said box.

* * * * *